US012084965B2

(12) United States Patent
Kirkpatrick et al.

(10) Patent No.: US 12,084,965 B2
(45) Date of Patent: Sep. 10, 2024

(54) ACOUSTIC TELEMETRY TOOL FOR HIGH MECHANICAL LOADING

(71) Applicant: WEATHERFORD TECHNOLOGY HOLDINGS, LLC, Houston, TX (US)

(72) Inventors: Cameron B. Kirkpatrick, Houston, TX (US); Ruben E. Martinez, Houston, TX (US); Seth D. Emig, Magnolia, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 227 days.

(21) Appl. No.: 17/728,009

(22) Filed: Apr. 25, 2022

(65) Prior Publication Data

US 2023/0340874 A1 Oct. 26, 2023

(51) Int. Cl.

| | |
|---|---|
| ***E21B 47/16*** | (2006.01) |
| ***E21B 17/042*** | (2006.01) |
| ***E21B 17/18*** | (2006.01) |
| ***E21B 47/01*** | (2012.01) |

(52) U.S. Cl.

CPC ..... *E21B 47/16* (2013.01); *E21B 17/042* (2013.01); *E21B 17/18* (2013.01); *E21B 47/01* (2013.01)

(58) Field of Classification Search

CPC ..... E21B 47/16; E21B 17/042; E21B 17/18; E21B 47/01

See application file for complete search history.

(56) References Cited

U.S. PATENT DOCUMENTS

| | | | | |
|---|---|---|---|---|
| 4,283,780 | A | 8/1981 | Nardi | |
| 6,144,316 | A * | 11/2000 | Skinner | E21B 47/13 340/853.3 |
| 10,415,376 | B2 * | 9/2019 | Song | E21B 47/005 |
| 10,669,842 | B2 * | 6/2020 | Xiao | B06B 1/0611 |
| 2019/0226330 | A1 | 7/2019 | Xiao | |

FOREIGN PATENT DOCUMENTS

| | | |
|---|---|---|
| EP | 0919696 A2 | 6/1999 |

OTHER PUBLICATIONS

International Search Report with Written Opinion issued Jun. 20, 2023 for PCT Patent Application No. PCT/IB2023/052211, 13 pages.

(Continued)

*Primary Examiner* — Nicole Coy

(74) *Attorney, Agent, or Firm* — Smith IP Services, P.C.

(57) ABSTRACT

An acoustic telemetry tool can include string connectors at respective opposite ends of the acoustic telemetry tool, a tubular outer housing extending longitudinally between the connectors, an inner mandrel extending longitudinally between the connectors, an annular chamber formed radially between the outer housing and the inner mandrel, and an acoustic telemetry assembly positioned in the annular chamber. In one acoustic telemetry tool, the outer housing is configured to transmit mechanical loads between the connectors, but the inner mandrel is configured to not transmit mechanical loads between the connectors. In another acoustic telemetry tool, the outer housing and the inner mandrel are configured to transmit mechanical loads between the connectors. In another tool, there may be multiple sets of outer housings, inner mandrels and acoustic telemetry assemblies.

23 Claims, 14 Drawing Sheets

(56) References Cited

OTHER PUBLICATIONS

Sandia National Laboratories; "Acoustic Telemetry", Sandia Report SAND2003-2614, dated Aug. 2003, 90 pages.
Halliburton; "Dynalink Telemetry System", product presentation H07823, dated Jul. 2011, 6 pages.
Schlumberger; "Muzic wireless telemetry", product brochure 21-RPEV-861568, dated 2021, 1 page.
Baker Hughes; "XACT bi-directional acoustic telemetry service", product brochure 81686, dated 2021, 2 pages.

* cited by examiner

ACOUSTIC TELEMETRY TOOL FOR HIGH MECHANICAL LOADING

BACKGROUND

This disclosure relates generally to equipment utilized and operations performed in conjunction with a subterranean well and, in examples described below, more particularly provides an acoustic telemetry tool suitable for use in high mechanical loading conditions.

It is known to use an acoustic telemetry tool connected in a tubular string to communicate acoustic signals in a well. Improvements in the art of designing, constructing and utilizing acoustic telemetry tools are continually needed.

It would be beneficial to be able to use an acoustic telemetry tool in high mechanical loading operations, such as, drilling, liner running, milling, etc. Improvements described below can be used in various well conditions and configurations, such as, high temperature and high pressure conditions, extended reach lateral wellbores, etc. However, principles of this disclosure are not limited to any particular well operation, condition or configuration.

DETAILED DESCRIPTION

Figure 1:
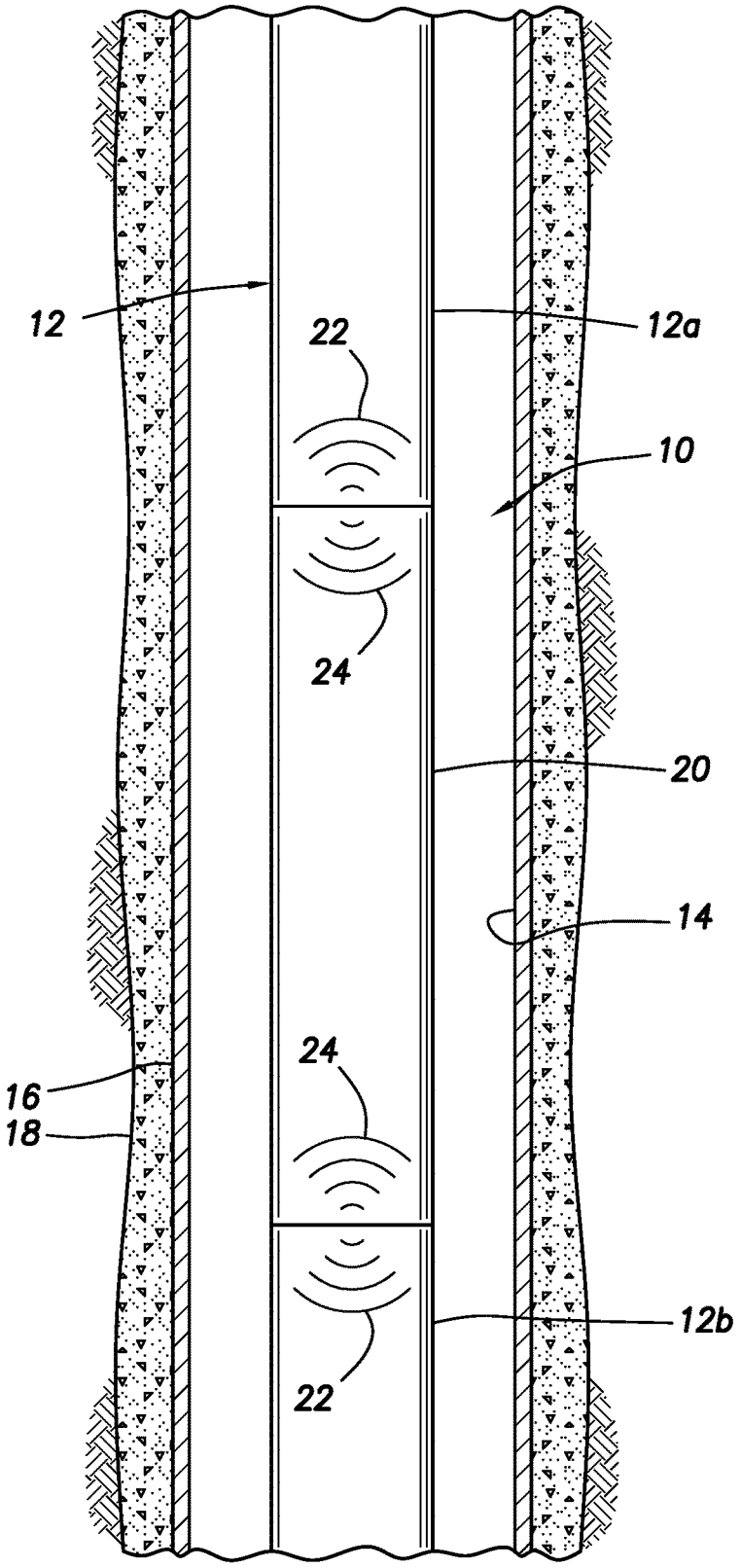
FIG. 1 is a representative partially cross-sectional view of an example of a well system and associated method which can embody the principles of this disclosure.

Representatively illustrated in FIG. 1 is an acoustic telemetry system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is deployed into a generally vertical wellbore 14. In other examples the wellbore 14 could be horizontal or otherwise inclined from vertical. As depicted in FIG. 1, the wellbore 14 is lined with casing 16 and cement 18, but in other examples the principles of this disclosure can be practiced in open hole or uncased wellbores.

The tubular string 12 may comprise any type of tubular string configured for use in a subterranean well. For example, the tubular string 12 could be a drill string, a work string, a drill stem test string, a stimulation string, a treatment string, a production string or an injection string. The tubular string 12 could comprise jointed or continuous tubing. The scope of this disclosure is not limited to use of any particular type of tubular string.

In some examples, the tubular string 12 could instead comprise a continuous or jointed rod string (such as, of the type used in artificial lift operations) and, thus, may not be tubular in form. Any media capable of conducting acoustic signals in a well may be used in place of, or in addition to, the tubular string 12.

In the FIG. 1 example, an acoustic telemetry tool 20 is connected in the tubular string 12. An upper section 12*a* of the tubular string 12 is connected uphole of the acoustic telemetry tool 20, and a lower section 12*b* of the tubular string is connected downhole of the acoustic telemetry tool.

As depicted in FIG. 1, the acoustic telemetry tool 20 is capable of transmitting acoustic signals 22 to the upper section 12*a* of the tubular string 12, and is capable of receiving acoustic signals 24 from the upper section. In addition, the acoustic telemetry tool 20 is capable of transmitting acoustic signals 22 to the lower section 12*b* of the tubular string 12, and is capable of receiving acoustic signals 24 from the lower section.

Note that it is not necessary for the acoustic telemetry tool 20 to transmit and receive acoustic signals 22, 24 bidirectionally in the tubular string 12. In some examples, the acoustic telemetry tool 20 could be configured to receive acoustic signals 24 from one of the upper and lower sections 12*a,b*, and to transmit acoustic signals 22 to the other one of the upper and lower sections, thus performing a relaying function. In other examples, the acoustic telemetry tool 20 could be configured to only transmit acoustic signals 22, such as, to transmit sensor readings to surface or another remote location. In other examples, the acoustic telemetry tool 20 could be configured to only receive acoustic signals 24, such as, to receive instructions or commands, sensor readings or other data for storage, processing or communication via another telemetry system. Accordingly, the scope of this disclosure is not limited to any particular direction of communication between the acoustic telemetry tool 20 and the remainder of the tubular string 12.

The acoustic telemetry tool 20 in the FIG. 1 example is configured to withstand relatively large mechanical loads (tension, compression, bending, torque, etc.). The acoustic telemetry tool 20 can transmit relatively large mechanical loads between the upper and lower sections 12*a,b* of the tubular string 12. This capability can be particularly useful when the tubular string 12 is, for example, a drill string, a liner running string, subjected to high pressure and high temperature conditions, etc.

Representatively illustrated in FIGS. 2-14 are examples of the acoustic telemetry tool 20. These acoustic telemetry tool 20 examples can be used in the system 10 and method of FIG. 1, or the acoustic telemetry tool examples can be used in other systems and methods.

The acoustic telemetry tool 20 in these examples includes string connectors at respective opposite ends of the acoustic telemetry tool, a tubular outer housing extending longitudinally between the connectors, an inner mandrel extending longitudinally between the connectors, an annular chamber formed radially between the outer housing and the inner mandrel, and an acoustic telemetry assembly positioned in the annular chamber. In one acoustic telemetry tool 20 example, the outer housing is configured to transmit mechanical loads between the connectors, but the inner mandrel is configured to not transmit mechanical loads between the connectors. In yet another acoustic telemetry tool 20, the outer housing and the inner mandrel are both configured to transmit mechanical loads between the connectors. In another acoustic telemetry tool 20, there may be multiple sets of outer housings, inner mandrels and acoustic telemetry assemblies.

Figure 2:
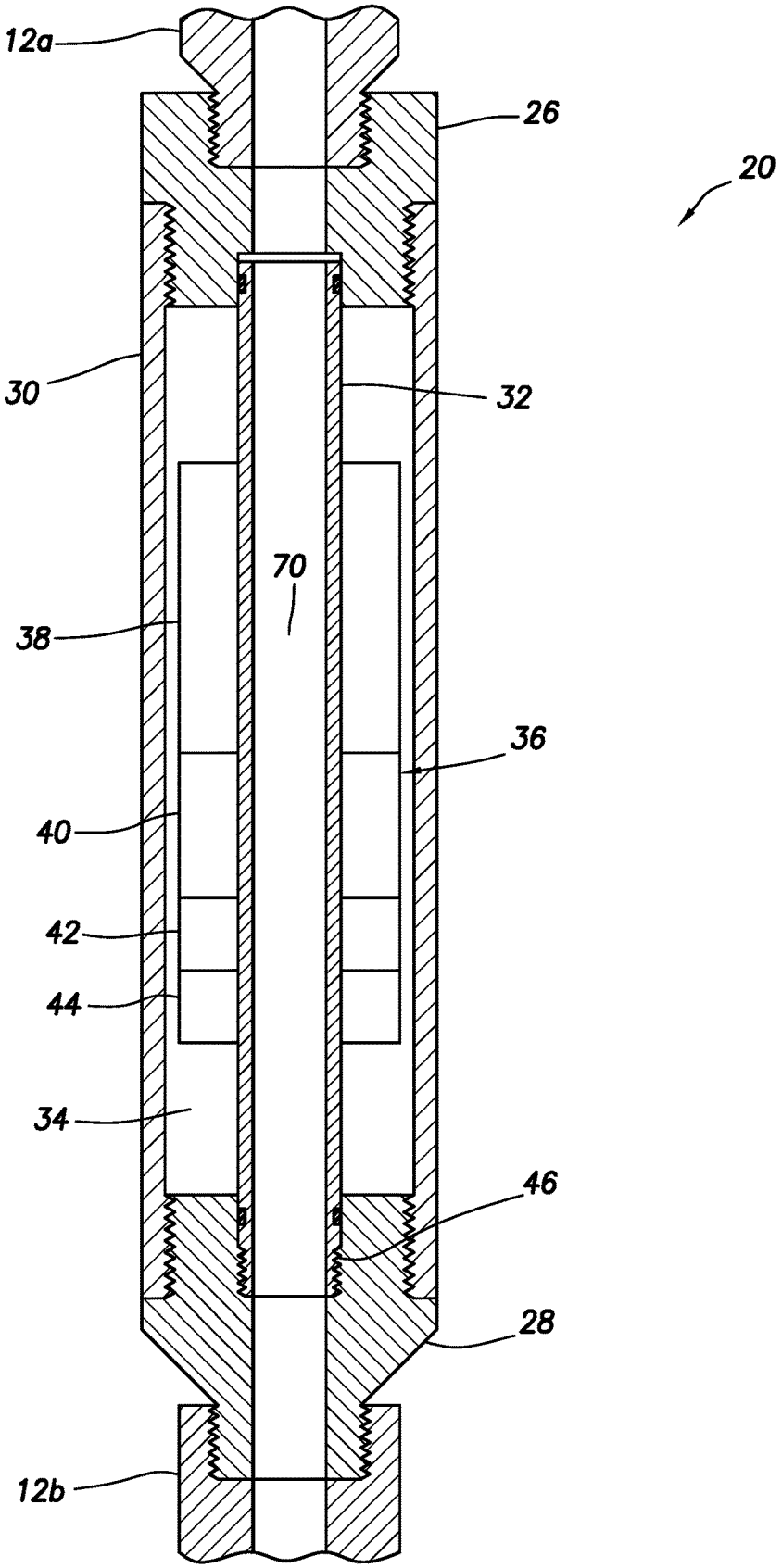
FIG. 2 is a representative cross-sectional view of an example of an acoustic telemetry tool that may be used in the system and method of FIG. 1, and which can embody the principles of this disclosure.

Referring specifically to FIG. 2, a cross-sectional view of one example of the acoustic telemetry tool 20 is representatively illustrated. In this example, the acoustic telemetry tool 20 includes tubular or rod string connectors 26, 28 at respective opposite ends of the acoustic telemetry tool, a tubular outer housing 30 extending longitudinally between the connectors, a tubular inner mandrel 32 extending longitudinally between the connectors, an annular chamber 34 formed radially between the outer housing and the inner mandrel, and an acoustic telemetry assembly 36 positioned in the annular chamber. A flow passage 70 of the tubular string 12 extends longitudinally through the acoustic telemetry tool 20.

Although the inner mandrel 32 is depicted in the drawings as being in tubular form, with the flow passage 70 extending longitudinally through the inner mandrel, in other examples the inner mandrel may not be tubular and the flow passage may not extend through the inner mandrel. For example, the inner mandrel 32 could be solid, or the flow passage 70 could be otherwise located (or not provided at all, such as, if the acoustic telemetry tool is connected in a rod string). Thus, the scope of this disclosure is not limited to any particular shape or configuration of any of the components of the acoustic telemetry tool 20.

In the FIG. 2 example, the outer housing 30 serves not only to contain the acoustic telemetry assembly 36, but also to transmit the mechanical loads between the upper and lower string connectors 26, 28. Since the upper string connector 26 is secured (e.g., using threads) with the upper section 12*a* of the tubular string 12, and the lower string connector 28 is secured (e.g., using threads) with the lower section 12*b* of the tubular string, the outer housing 30 also transmits the mechanical loads between the upper and lower sections 12*a,b*. The outer housing 30 can also transmit acoustic signals 22, 24 (see FIG. 1) between the string connectors 26, 28.

In the FIG. 2 example, the acoustic telemetry assembly 36 is rigidly secured to an exterior of the inner mandrel 32. The acoustic telemetry assembly 36 can be made up of multiple modules, each of which is separately clamped or otherwise secured to the inner mandrel 32 (see FIG. 6), or the entire acoustic telemetry assembly could be secured to the inner mandrel as a unit. In other examples, components of the acoustic telemetry assembly 36 could be received in recesses formed on or secured to the inner mandrel 32. In further examples, components of the acoustic telemetry assembly 36 could be secured to one or both of the connectors 26, 28 and/or the outer housing 30.

The scope of this disclosure is not limited to any particular manner in which the acoustic telemetry assembly 36 is mounted to, secured with or connected to the inner mandrel 32. Preferably, the mounting, securing or connecting method is designed for optimal communication of acoustic signals 22 and/or 24 between the inner mandrel 32 and at least certain components of the acoustic telemetry assembly 36 (such as, acoustic transmitter and/or receiver components).

As depicted in FIG. 2, the acoustic telemetry assembly 36 includes batteries 38, electronic circuitry 40, an acoustic receiver or sensor 42, and an acoustic transmitter 44. In other examples, more, fewer or a different combination of components may be used. The scope of this disclosure is not limited to any particular components or combination of components in the acoustic telemetry assembly 36.

The batteries 38 provide electrical power for the electronic circuitry 40 and the acoustic telemetry devices (the acoustic sensor 42 and transmitter 44). The acoustic sensor 42 is capable of detecting acoustic signals 24 transmitted in the inner mandrel 32, and the acoustic transmitter 44 is capable of transmitting acoustic signals 22 to the inner mandrel. The electronic circuitry 40 controls operation of the acoustic telemetry devices 42, 44 and provides storage and processing of received acoustic signals 24. Instructions for operation of the acoustic telemetry assembly 36 can be stored in memory of the electronic circuitry 40.

In the FIG. 2 example, the inner mandrel 32 is secured with the lower string connector 28 using threads 46. In other examples, other securing methods (such as, welding, integrally forming, etc.) may be used to rigidly connect the inner mandrel 32 with the lower string connector 28. Preferably, the securing method is designed to efficiently transmit acoustic signals 22, 24 between the inner mandrel 32 and the lower string connector 28, so that the acoustic telemetry devices 42, 44 are in acoustic communication with the upper and lower sections 12*a,b* of the tubular string 12 via the inner mandrel 32, the lower string connector 28, the outer housing 30 and the upper string connector 26.

As depicted in FIG. 2, an upper end of the inner mandrel 32 is sealingly and slidingly received in the upper string connector 26. Thus, the upper end of the inner mandrel 32 is longitudinally displaceable relative to the string connector 26.

In other examples, the upper end of the inner mandrel 32 could be secured to the string connector 26 (e.g., using threads, etc.), or a biasing device could be installed between the upper end of the inner mandrel and the string connector in order to pre-load the inner mandrel in compression. In this manner, acoustic signals 22, 24 could be transmitted between the upper end of the inner mandrel 32 and the upper string connector 26.

Figure 3:
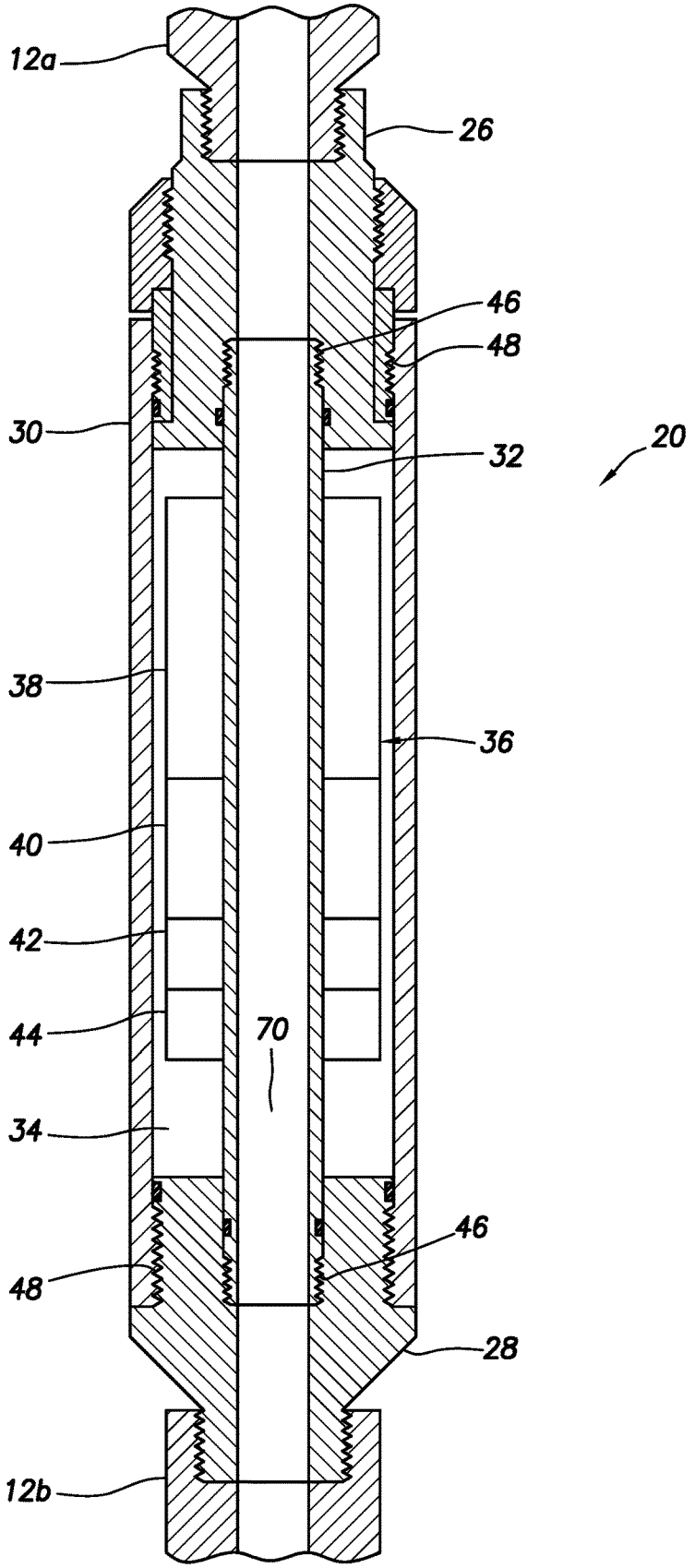
FIG. 3 is a representative cross-sectional view of another example of the acoustic telemetry tool.

Referring additionally now to FIG. 3, a cross-sectional view of another example of the acoustic telemetry tool 20 is representatively illustrated. In this example, mechanical loads are transmitted between the upper and lower string connectors 26, 28 by the inner mandrel 32 and by the outer housing 30.

As depicted in FIG. 3, the upper end of the inner mandrel 32 is secured with the upper string connector 26 using threads 46, similar to the manner in which the lower end of the inner mandrel is secured with the lower string connector 28. Other methods of securely connecting the ends of the inner mandrel 32 with the string connectors 26, 28 may be used in other examples. For example, an end of the inner mandrel 32 could be integrally formed with one of the string connectors 26, 28.

The upper and lower ends of the outer housing 30 are secured with the respective upper and lower string connectors 26, 28 using threads 48. Other methods of securely connecting the ends of the outer housing 30 with the string connectors 26, 28 may be used in other examples.

The outer housing 30 and the inner mandrel 32 may be designed to share the mechanical loads evenly, or in other proportions. For example, the outer housing 30 may have a larger cross-sectional area and moment of inertia than the inner mandrel 32, and so the outer housing may be able to bear more of the mechanical loading than the inner mandrel.

In the FIG. 3 example, both of the outer housing 30 and the inner mandrel 32 can communicate acoustic signals 22, 24 between the string connectors 26, 28. Thus, both of the outer housing 30 and the inner mandrel 32 can communicate acoustic signals 22, 24 between the upper and lower tubular string sections 12*a,b*.

Figure 4A:
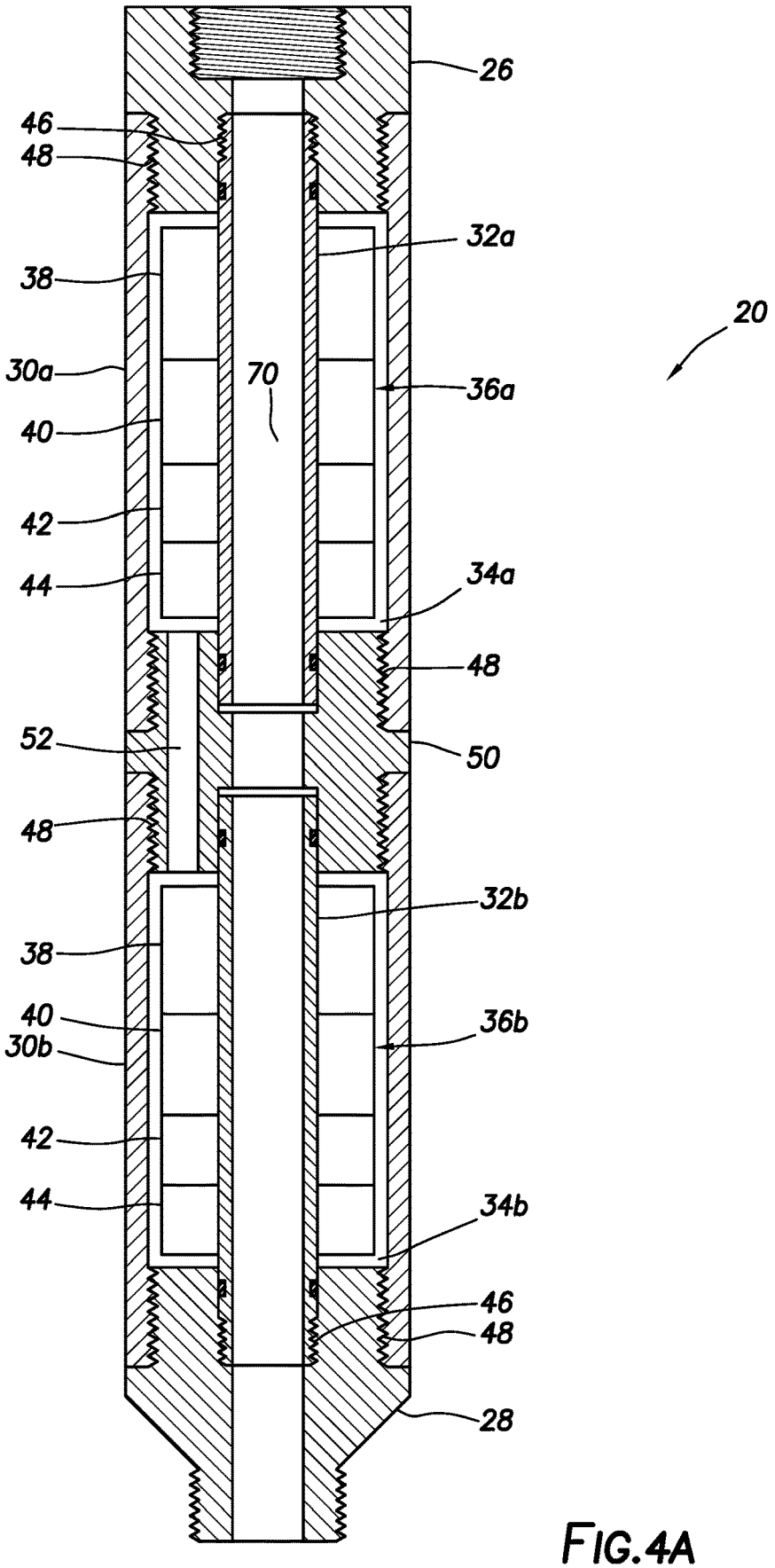
FIG. 4A is a representative cross-sectional view of another example of the acoustic telemetry tool.

Referring additionally now to FIG. 4A, a cross-sectional view of another example of the acoustic telemetry tool 20 is representatively illustrated. In this example, mechanical loads are transmitted between the upper and lower string connectors 26, 28 by multiple outer housings 30*a,b*. A tubular intermediate connector 50 is secured between the outer housings 30*a,b* with threads 48. Thus, mechanical loads and acoustic signals 22, 24 can be communicated between the string connectors 26, 28 via the connected outer housings 30*a,b* and the intermediate connector 50.

The FIG. 4A acoustic telemetry tool 20 also includes multiple inner mandrels 32*a,b*. An upper end of the upper inner mandrel 32*a* is secured with the string connector 26 by threads 46, and a lower end is slidingly and sealingly received in the intermediate connector 50. A lower end of the lower inner mandrel 32*b* is secured with the string connector 28 by threads 46, and an upper end is slidingly and sealingly received in the intermediate connector 50. Thus, the inner mandrels 32*a,b* are not configured to transmit mechanical loads between the string connectors 26, 28, but acoustic signals 22, 24 can be communicated between each of the inner mandrels 32*a,b* and the respective string connector 26, 28.

In any of the examples described herein, the threads 46 may be replaced by other types of rigid connections capable of transmitting acoustic signals. For example, flanged, bolted or welded joints may be used in place of the threads 46.

Acoustic telemetry assemblies 36*a,b* are contained in respective annular chambers 34*a,b* formed radially between the outer housings 30*a,b* and the inner mandrels 32*a,b*. In the FIG. 4A example, the acoustic telemetry assemblies 36*a,b* are the same, but in other examples they could be different (such as, with different components or different types of components, etc.). An opening 52 extending longitudinally through the intermediate connector 50 can provide for wired, hydraulic, optical or other forms of communication between the acoustic telemetry assemblies 36*a,b*.

Although, in the FIG. 4A example, there are two sets of outer housing, inner mandrel and acoustic telemetry assembly connected between the string connectors 26, 28, in other examples other numbers of sets could be used. A separate intermediate connector 50 could be connected between each adjacent pair of the sets.

Figure 4B:
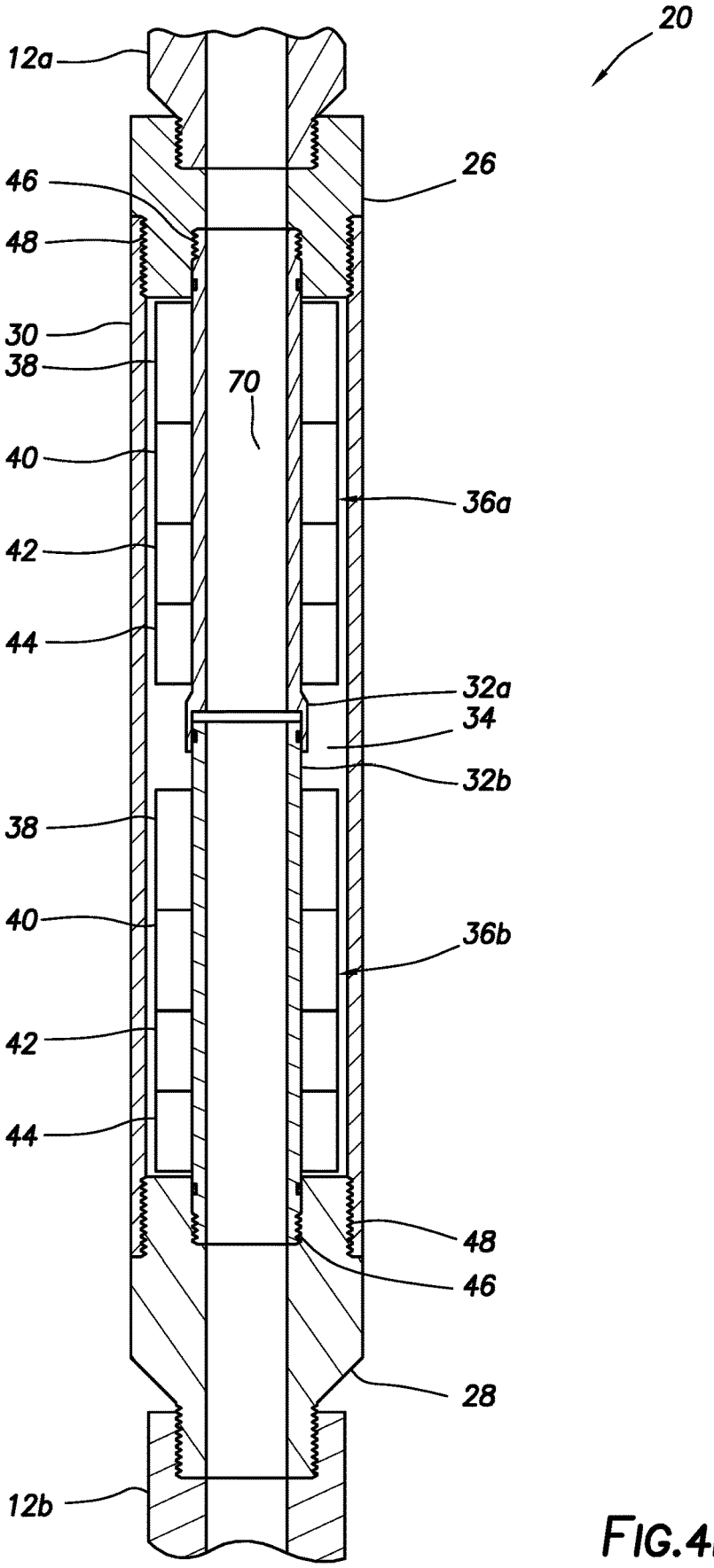
FIG. 4B is a representative cross-sectional view of an optional configuration of the FIG. 4A acoustic telemetry tool.

Referring additionally now to FIG. 4B, an optional configuration of the acoustic telemetry tool 20 is representatively illustrated. The FIG. 4B example is similar in most respects to the FIG. 4A example, but differs in that the intermediate connector 50 is not used and a single outer housing 30 is used in place of the multiple outer housings 30*a,b*.

In the FIG. 4B example, the upper and lower inner mandrels 32*a,b* are slidingly and sealingly engaged with each other. Both of the acoustic telemetry assemblies 36*a,b* are contained in the outer housing 30.

Figure 5:
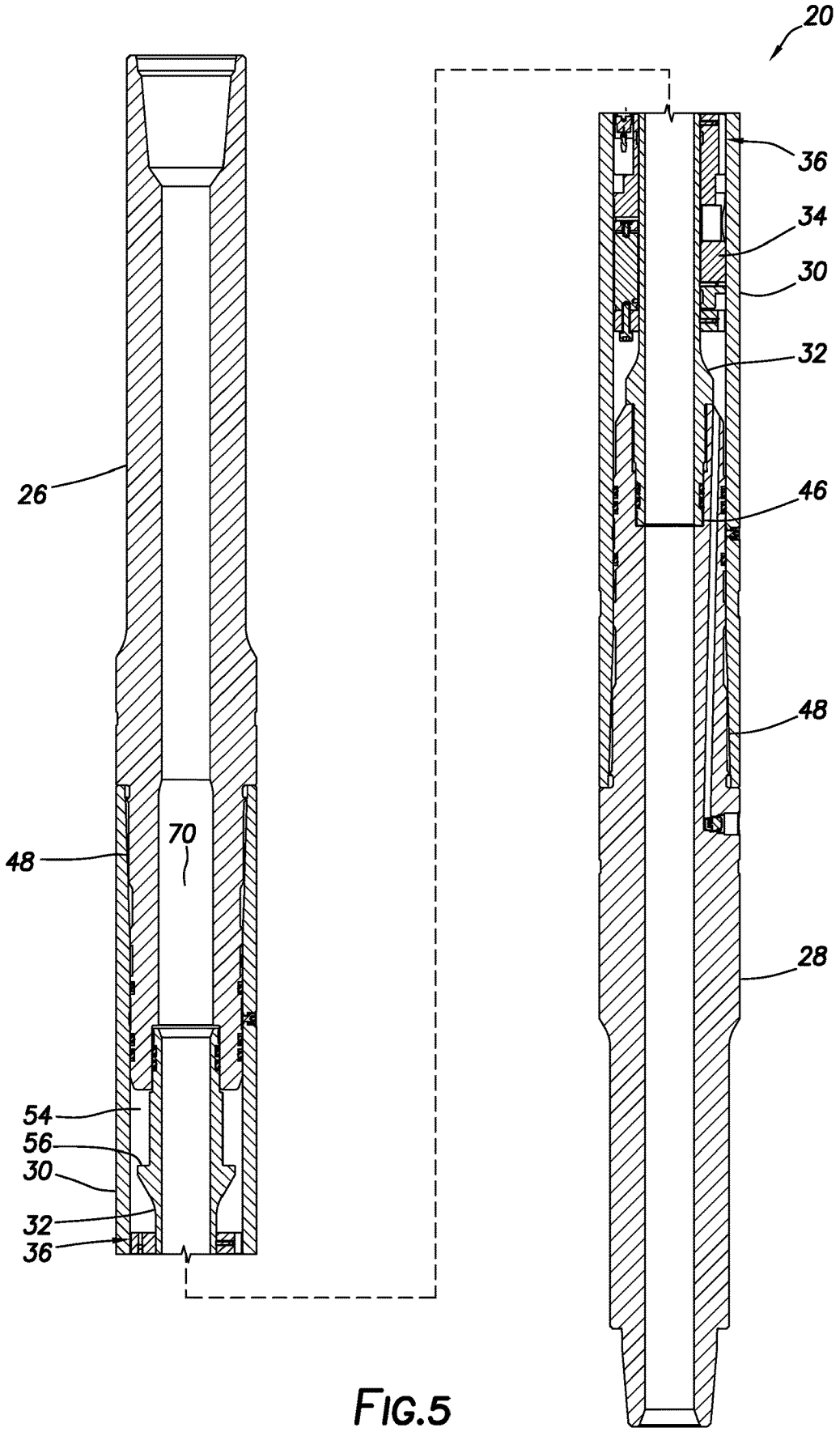
FIG. 5 is a representative cross-sectional view of another example of the acoustic telemetry tool.

Referring additionally now to FIG. 5, a cross-sectional view of another example of the acoustic telemetry tool 20 is representatively illustrated. The FIG. 5 example is similar in many respects to the FIG. 2 example.

The outer housing 30 is secured with each of the string connectors 26, 28 by threads 48. Thus, mechanical loads and acoustic signals 22, 24 can be transmitted between the string connectors 26, 28 via the outer housing 30. Other methods of securely connecting the outer housing 30 to the string connectors 26, 28 may be used in other examples.

A lower end of the inner mandrel 32 is secured with the string connector 28 by threads 46. An upper end of the inner mandrel 32 is slidingly and sealingly received in the string connector 26. Thus, the inner mandrel 32 is not configured to transmit mechanical loads or acoustic signals 22, 24 between the string connectors 26, 28, but the threaded connection at the lower end of the inner mandrel can permit communication of acoustic signals 22, 24 between the inner mandrel and the string connector 28.

Note that an annular recess 54 is formed externally on the inner mandrel 32. The annular recess 54 is disposed longitudinally between the string connector 26 and an external shoulder 56 on the inner mandrel 32. A biasing device may be positioned in the annular recess 54, in order to apply a compressive force or pre-load in the inner mandrel 32. If the biasing device has a sufficient stiffness, it may be possible to communicate acoustic signals 22, 24 between the upper end of the inner mandrel 32 and the string connector 26.

Figure 6:
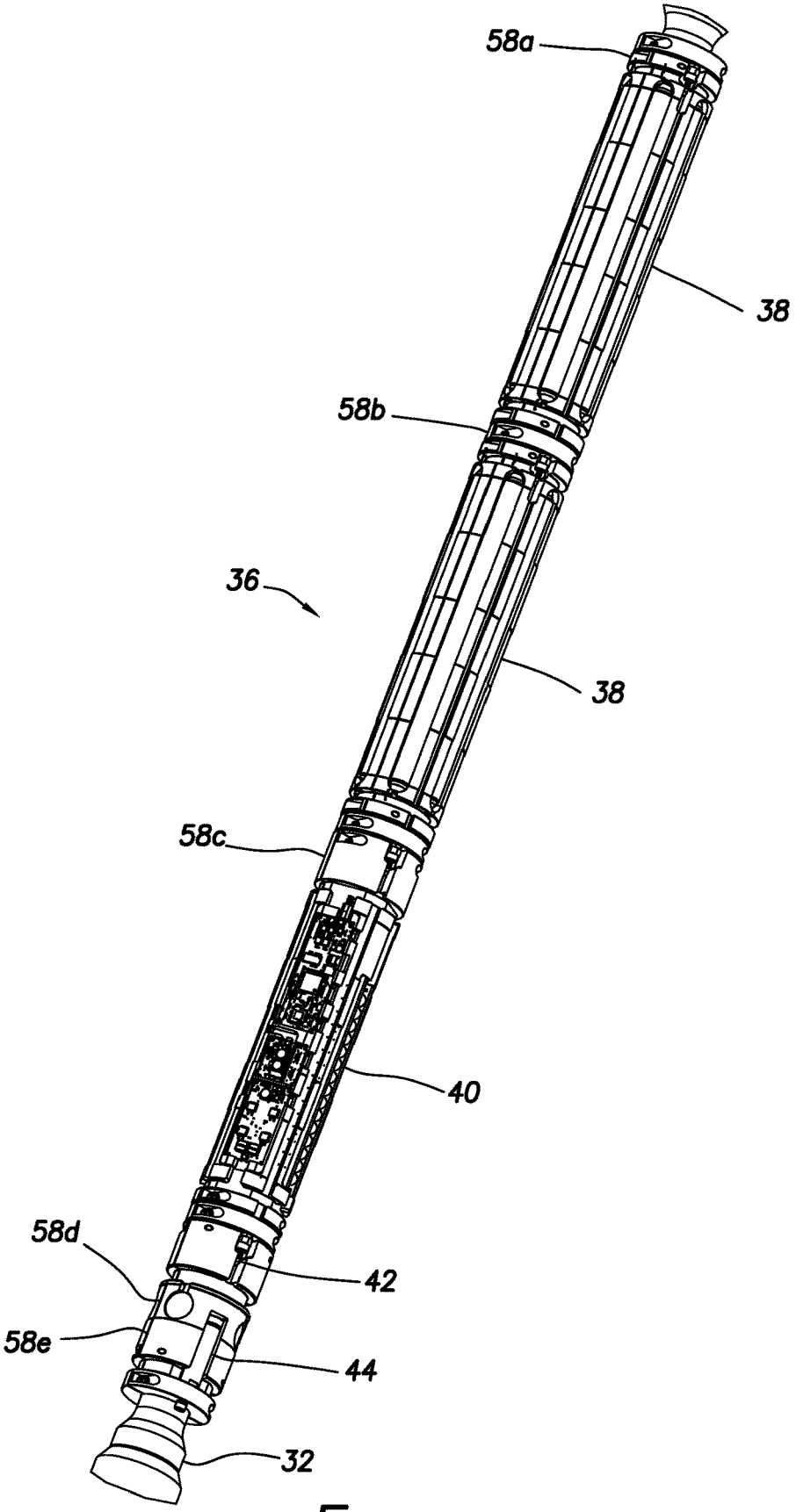
FIG. 6 is a representative perspective view of an example of an acoustic telemetry assembly that may be used with the acoustic telemetry tool.

Referring additionally now to FIG. 6, a perspective view of an example of the acoustic telemetry assembly 36 is representatively illustrated. In this example, two sets of the batteries 38 are used. The batteries 38, electronic circuitry 40, acoustic sensor 42 and acoustic transmitter 44 are each disposed in a respective module 58*a-e*. The separate modules 58*a-e* are clamped onto the exterior of the inner mandrel 32.

Figure 7:
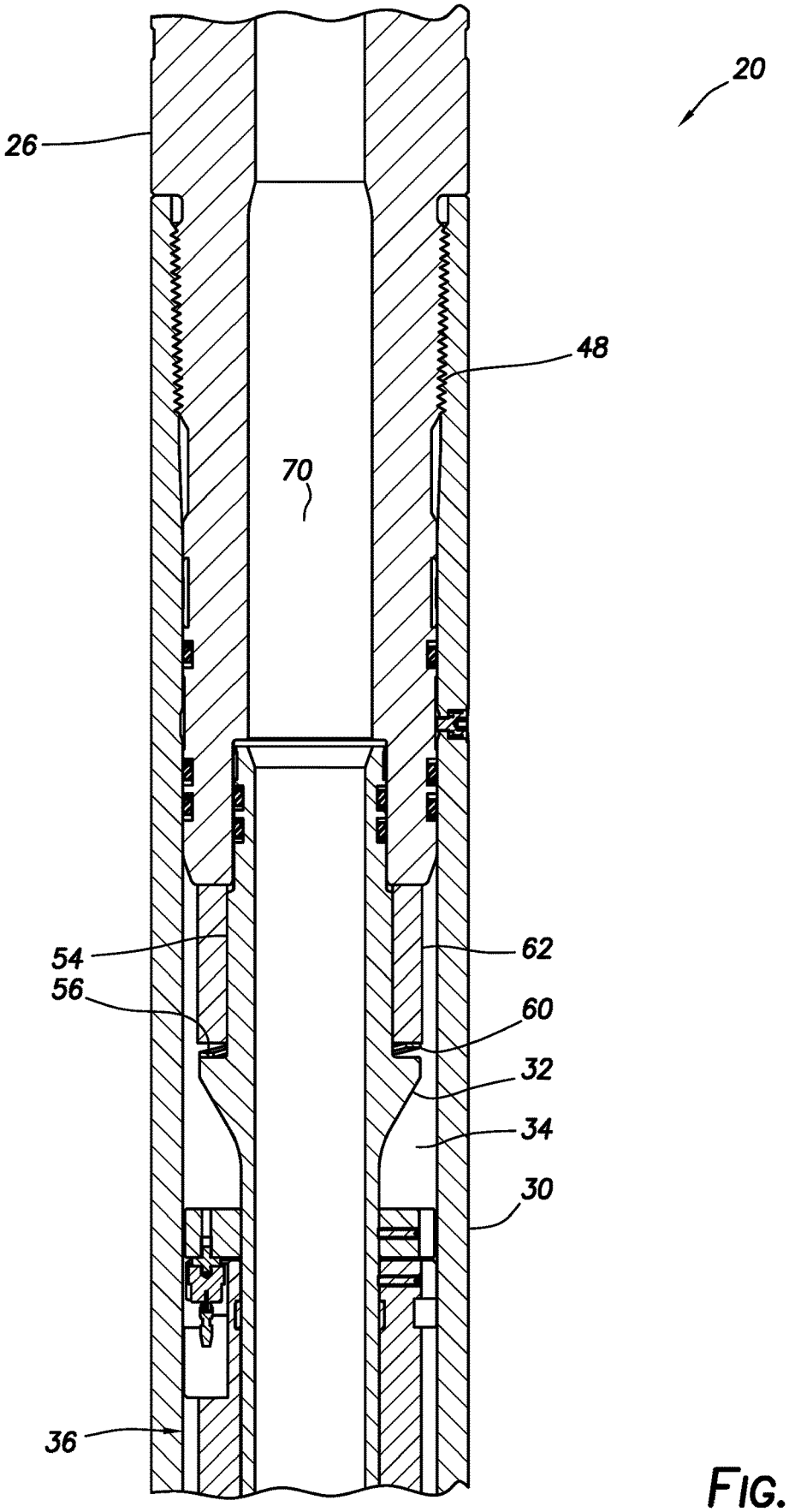
FIG. 7 is a representative cross-sectional view of a section of the FIG. 6 acoustic telemetry tool.

Referring additionally now to FIG. 7, a cross-sectional view of a section of the FIG. 5 acoustic telemetry module 20 is representatively illustrated. In this view, a biasing device 60 can be seen disposed in the annular recess 54 between the string connector 26 and the shoulder 56. The biasing device 60 can apply a compressive force or pre-load to the inner mandrel 32, as discussed above.

In the FIG. 7 example, a tubular spacer 62 is positioned between the biasing device 60 and the string connector 26. A length of the spacer 62 can be changed to accommodate different biasing device 60 lengths, or to achieve different amounts of compressive pre-load in the inner mandrel 32.

The biasing device 60 may comprise any type of compression spring (such as, coiled, wave and disc (Belleville washers) may be used), resilient material, or a gas or liquid spring. The biasing device 60 and any spacer 62 can be designed to permit acoustic communication between the string connector 26 and the upper end of the inner mandrel 32, while mechanical loads (other than the compressive force exerted by the biasing device 60) cannot be transmitted between the string connector and the upper end of the inner mandrel.

Figure 9:
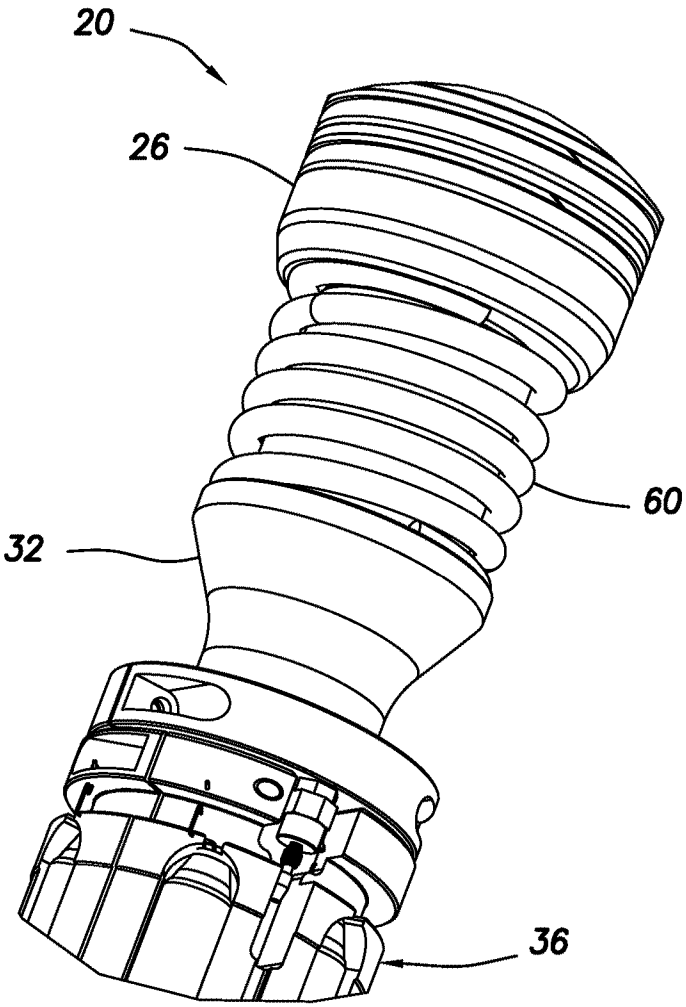
FIGS. 8 & 9 are representative perspective views of biasing device configurations that may be used with the FIG. 6 acoustic telemetry tool.
Figure 8:
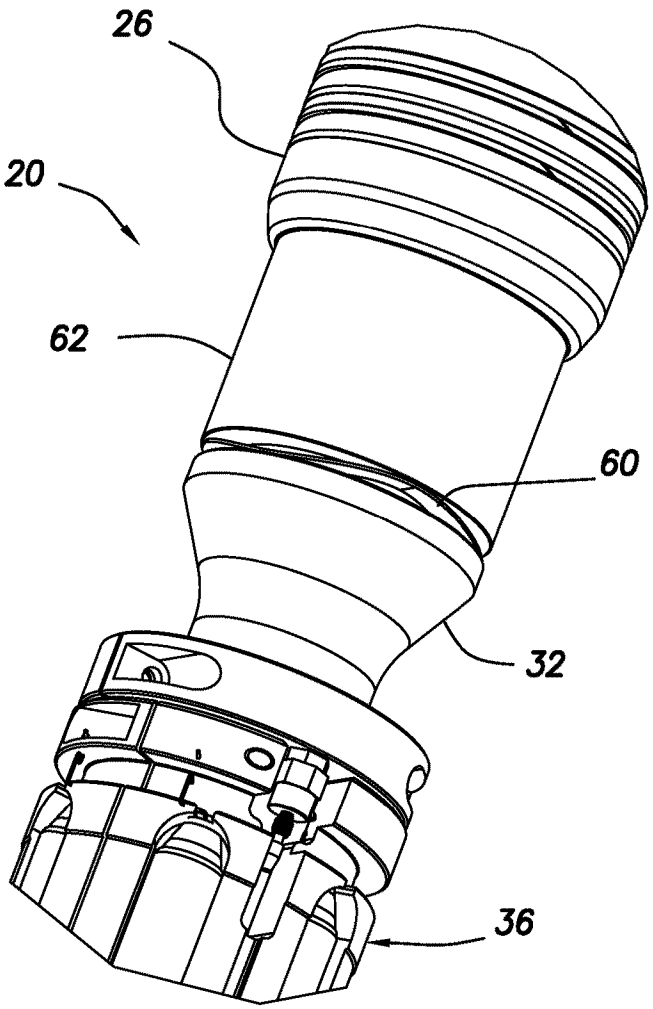

Referring additionally now to FIGS. 8 & 9, perspective views of a section of the acoustic telemetry tool 20 are representatively illustrated. In FIG. 8, the biasing device 60 is in the form of a wave spring positioned between the spacer 62 and the shoulder 56 (see FIG. 8) on the inner mandrel 32. In FIG. 9, the biasing device 60 is in the form of a coiled spring and the spacer 62 is not used.

Figure 10:
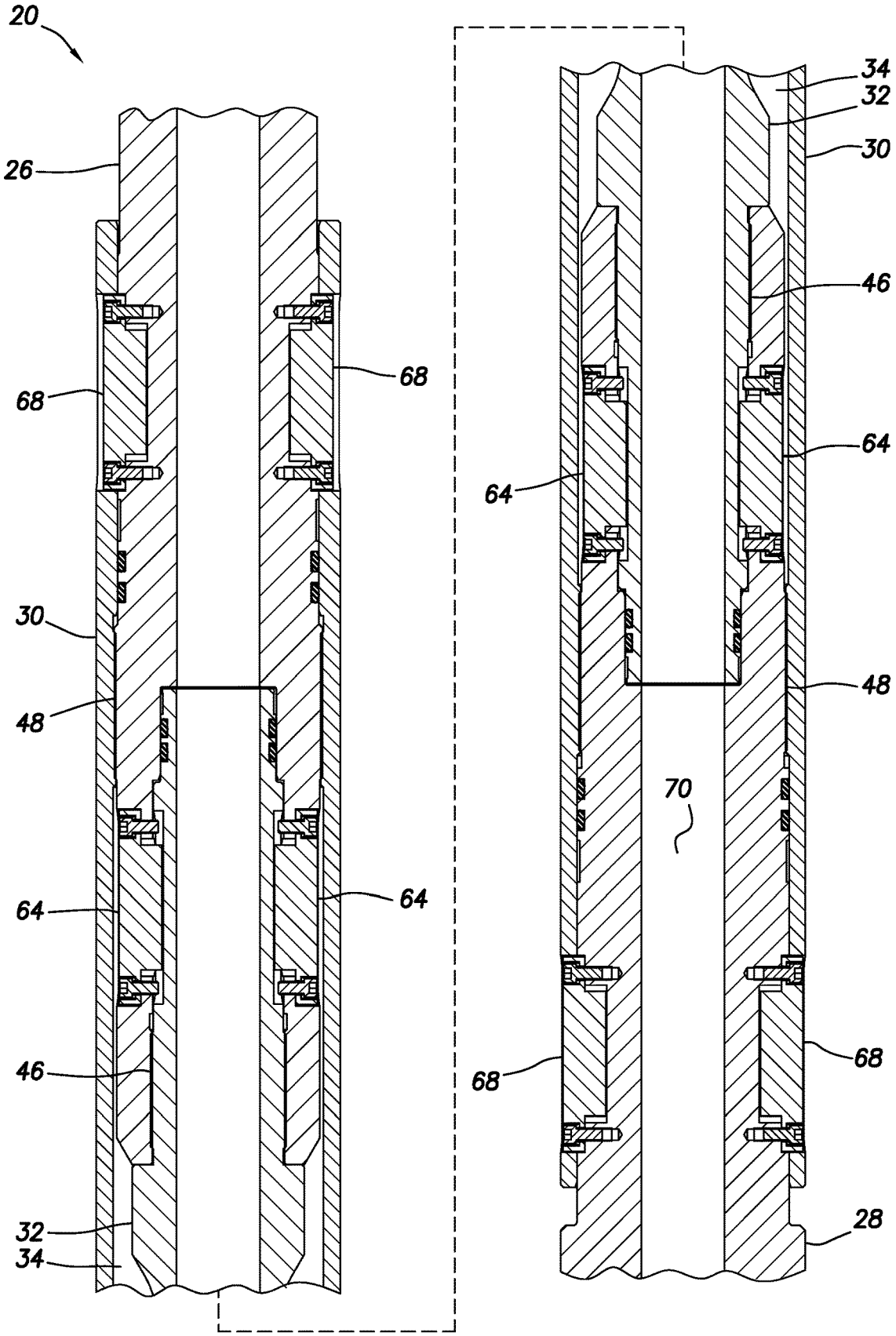
FIG. 10 is a representative cross-sectional view of another example of the acoustic telemetry tool.

Referring additionally now to FIG. 10, a cross-sectional view of another example of the acoustic telemetry tool 20 is representatively illustrated. The FIG. 10 example is similar in many respects to the FIG. 3 example.

As depicted in FIG. 10, the outer housing 30 is secured with the string connectors 26, 28 by threads 48. The inner mandrel 32 is secured with the string connectors 26, 28 by threads 46. Thus, both the outer housing 30 and the inner mandrel 32 are capable of transmitting mechanical loads and acoustic signals 22, 24 between the string connectors 26, 28.

In addition, torque-resisting dogs 64 are installed through the string connectors 26, 28 and into slots formed near the upper and lower ends of the inner mandrel 32. Torque-resisting dogs 68 are installed through radial openings at opposite ends of the outer housing 30 and into slots formed on the respective string connectors 26, 28. The dogs 64, 68 prevent relative rotation between each of the outer housing 30, the inner mandrel 32 and the string connectors 26, 28.

Figure 11:
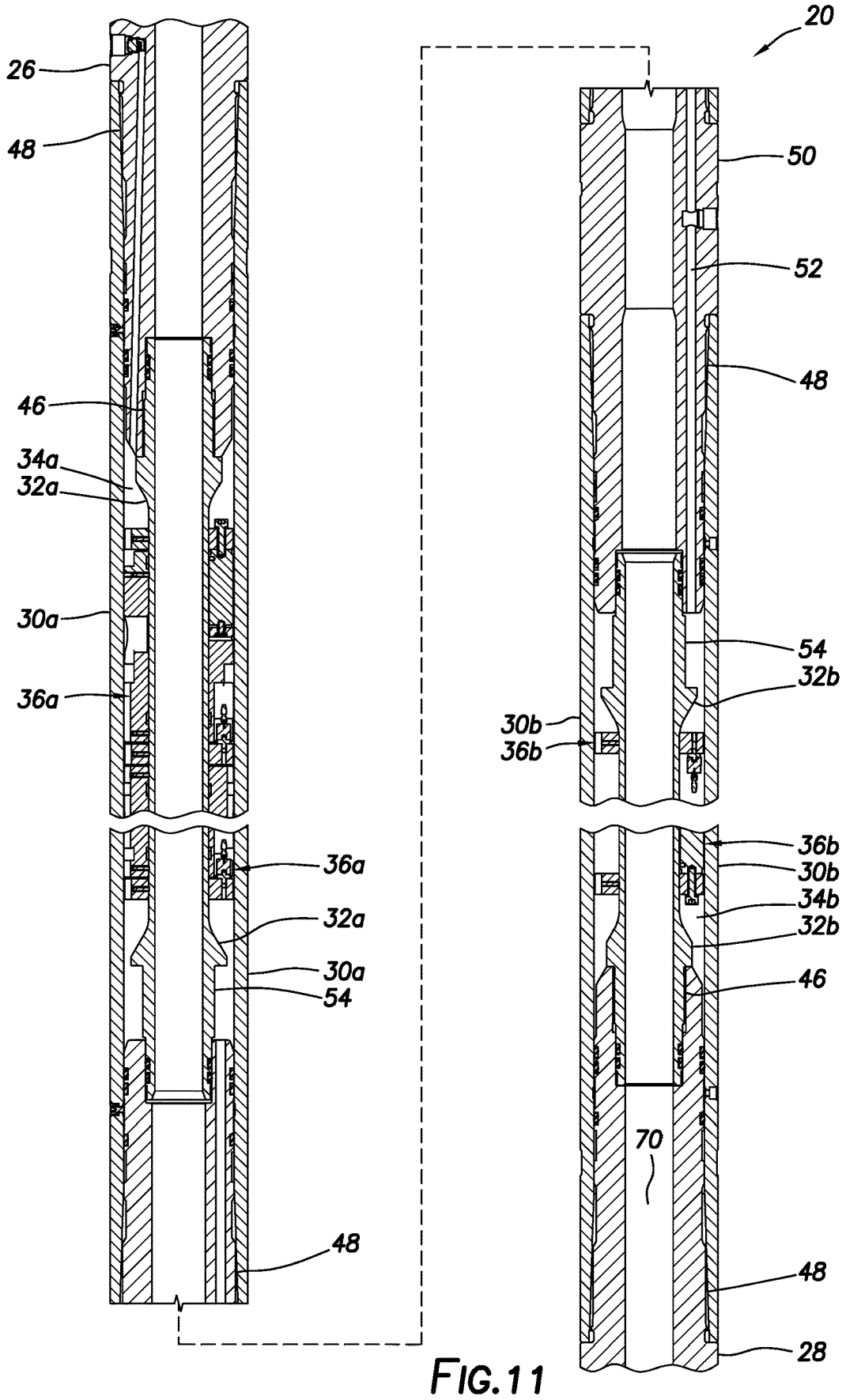
FIG. 11 is a representative cross-sectional view of another example of the acoustic telemetry tool.

Referring additionally now to FIG. 11, a cross-sectional view of another example of the acoustic telemetry tool 20 is representatively illustrated. The FIG. 11 example is similar in many respects to the FIG. 4 example.

In the FIG. 11 example, the acoustic telemetry tool 20 includes two sets of outer housings 30*a,b*, inner mandrels 32*a,b* and acoustic telemetry assemblies 36*a,b*. An intermediate connector 50 is securely connected between the two sets of outer housings 30*a,b* by respective threads 48. The outer housings 30*a,b* and inner mandrels 32*a,b* are securely connected to the respective string connectors 26, 28 by corresponding threads 48, 46. The inner mandrels 32*a,b* are slidingly and sealingly received in respective opposite ends of the intermediate connector 50.

Thus, mechanical loads and acoustic signals 22, 24 can be transmitted between the string connectors 26, 28 via the outer housings 30*a,b* and the intermediate connector 50. Acoustic signals 22, 24 can also be transmitted between the string connector 26 and the upper end of the inner mandrel 32*a*, and between the string connector 28 and the lower end of the inner mandrel 32*b*.

However, the inner mandrels 32*a,b* do not transmit mechanical loads between the string connectors 26, 28. In some examples, biasing devices (such as, the biasing devices 60 described above) may be installed in annular recesses formed on the inner mandrels 32*a,b*, in order to apply compressive pre-loads to the inner mandrels. In that case, acoustic signals 22, 24 could be transmitted between the string connectors 26, 28 and the respective inner mandrels 32*a,b* via the biasing devices.

Figure 12:
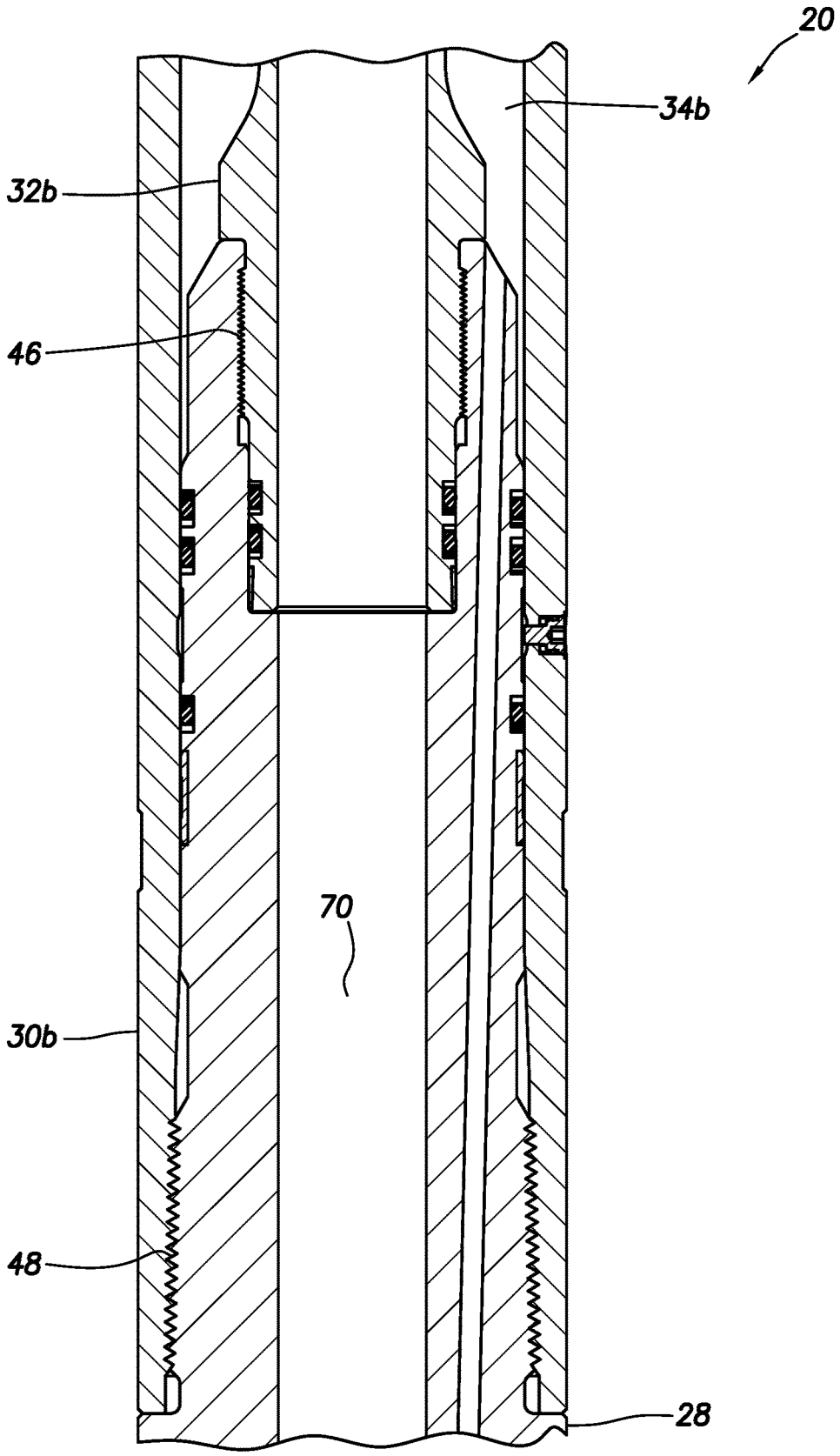
FIG. 12 is a representative cross-sectional view of a lower connector configuration that may be used with the FIG. 13 acoustic telemetry tool.

Referring additionally now to FIG. 12, a cross-sectional view of a section of the FIG. 11 acoustic telemetry tool 20 is representatively illustrated. As depicted in FIG. 12, a lower end of the inner mandrel 32*b* is threadedly secured to an upper end of the string connector 28. A lower end of the outer housing 30*b* is also threadedly secured to the string connector 28. In other examples, torque-resisting dogs 68 (see FIG. 10) could be used to prevent relative rotation between the outer housing 30*b* and the string connector 28.

Figure 13:
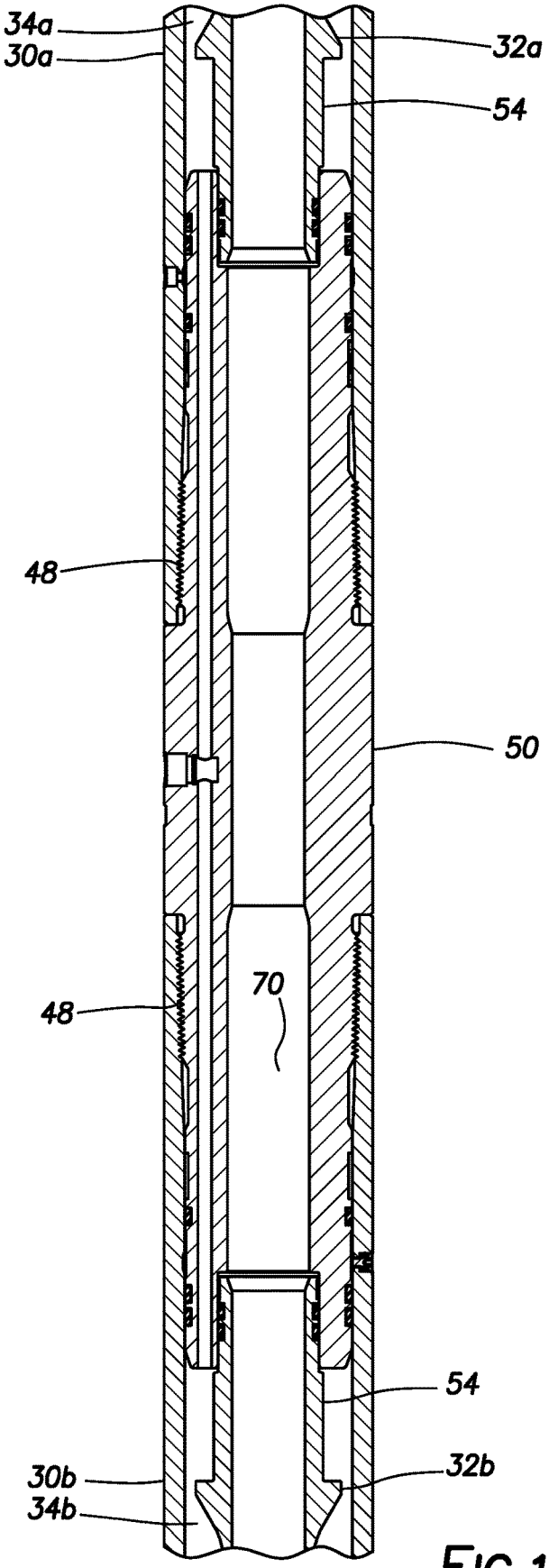
FIG. 13 is a representative cross-sectional view of an intermediate connector section of the FIG. 13 acoustic telemetry tool.

Referring additionally now to FIG. 13, a cross-sectional view of another section of the FIG. 11 acoustic telemetry tool 20 is representatively illustrated. As depicted in FIG. 13, the outer housings 30*a,b* are threadedly secured to respective opposite ends of the intermediate connector 50. The inner mandrels 32*a,b* are slidingly and sealingly received in the respective opposite ends of the intermediate connector 50. Biasing devices 60 may be installed in the annular recesses 54 to bias the inner mandrels 32*a,b* away from the intermediate connector 50, and to apply a compressive pre-load to the inner mandrels.

Figure 14:
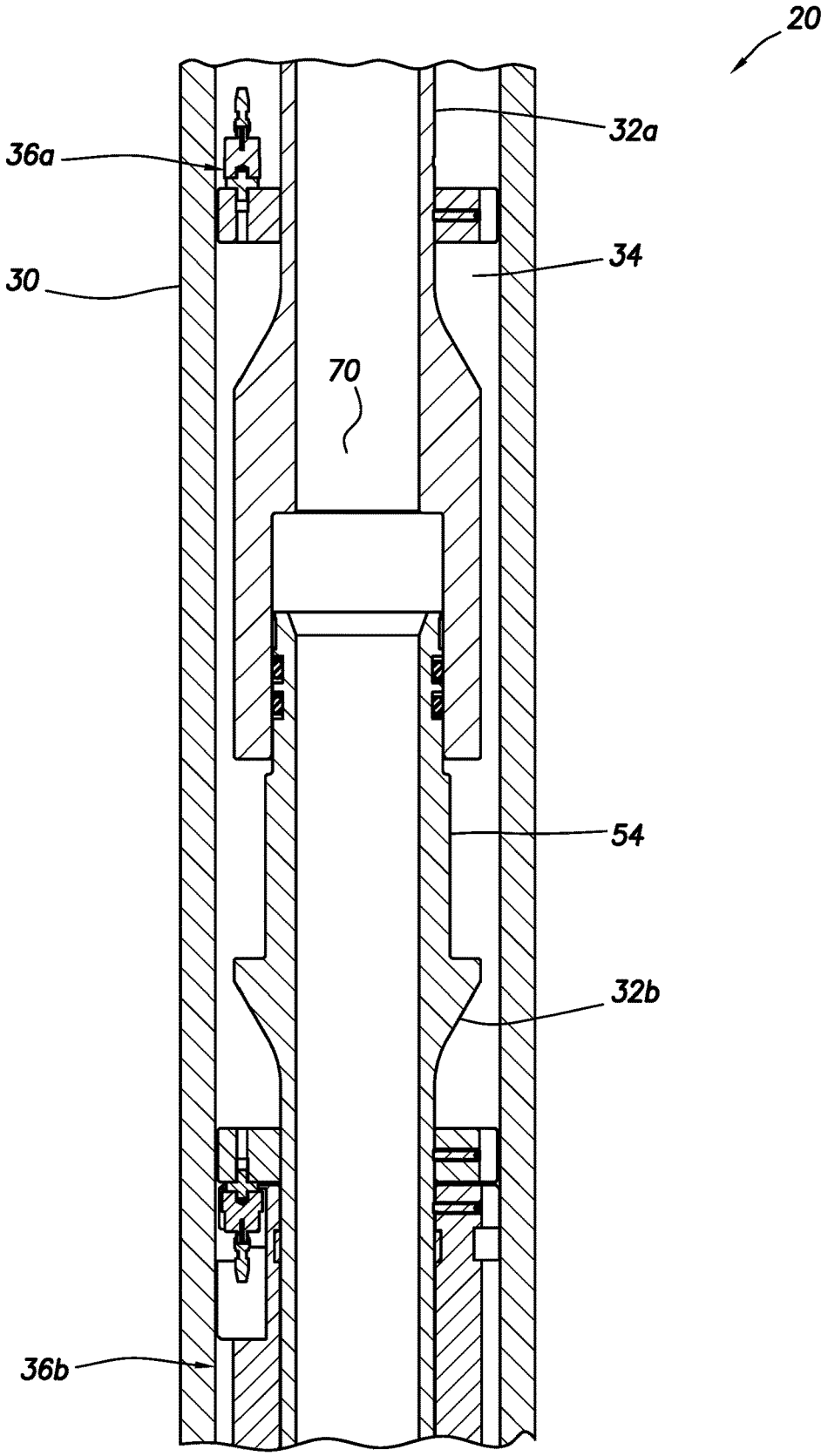
FIG. 14 is a representative cross-sectional view of another example of the acoustic telemetry tool.

Referring additionally now to FIG. 14, a cross-sectional view of a variation of the FIG. 11 acoustic telemetry tool 20 example is representatively illustrated. In the FIG. 14 example, the intermediate connector 50 is not used. A single outer housing 30 extends between the string connectors 26, 28. Both of the acoustic telemetry assemblies 36*a,b* are contained in the outer housing 30.

An upper end of the inner mandrel 32*b* is slidingly and sealingly received in a lower end of the inner mandrel 32*a*. The inner mandrels 32*a,b* may be biased away from each other by installing a biasing device 60 in an annular recess 54 formed on the inner mandrel 32*b*. The biasing device 60 exerts a compressive force that is applied to each of the inner mandrels 32*a,b*. In this manner, acoustic signals 22, 24 can be transmitted between the acoustic telemetry assemblies 36*a,b*.

It may now be fully appreciated that the above disclosure provides significant advancements to the art of communicating acoustic signals in a tubular string in a well. In examples described above, an acoustic telemetry tool 20 is configured to transmit relatively high mechanical loads through the tubular string 12, and to communicate acoustic signals 22, 24 in the tubular string.

An acoustic telemetry tool 20 for use in a subterranean well is provided to the art by the above disclosure. In one example, the acoustic telemetry tool 20 can include: first and second string connectors 26, 28 at respective opposite ends of the acoustic telemetry tool 20; a tubular outer housing 30 extending longitudinally between the first and second connectors 26, 28; an inner mandrel 32 extending longitudinally between the first and second connectors 26, 28, an annular chamber 34 being formed radially between the outer housing 30 and the inner mandrel 32; and an acoustic telemetry assembly 36 positioned in the annular chamber 34. The outer housing 30 is configured to transmit mechanical loads between the first and second connectors 26, 28, but the inner mandrel 32 is configured to not transmit the mechanical loads between the first and second connectors 26, 28.

In any of the examples described herein:

The acoustic telemetry assembly 36 may be configured for communication of acoustic signals 22, 24 between the acoustic telemetry assembly 36 and the outer housing 30. The acoustic telemetry assembly 36 may be rigidly secured to the inner mandrel 32. The acoustic telemetry assembly 36 may be clamped to the inner mandrel 32. The acoustic telemetry assembly 36 may include at least one battery 38, electronic circuitry 40 and an acoustic telemetry device selected from the group consisting of an acoustic transmitter 44 and an acoustic sensor 42.

The inner mandrel 32 may be threadedly secured with the second connector 28, and the inner mandrel 32 may be longitudinally displaceable relative to the first connector 26. The inner mandrel 32 may be slidingly and sealingly received in the first connector 26. A biasing device 60 may apply a compressive force to the inner mandrel 32.

Also provided to the art by the above disclosure is another acoustic telemetry tool 20 example comprising: first and second string connectors 26, 28 at respective opposite ends of the acoustic telemetry tool 20; a tubular outer housing 30 extending longitudinally between the first and second connectors 26, 28; an inner mandrel 32 extending longitudinally between the first and second connectors 26, 28, an annular chamber 34 being formed radially between the outer housing 30 and the inner mandrel 32; and an acoustic telemetry assembly 36 positioned in the annular chamber 34. The inner mandrel 32 and the outer housing 30 are configured to transmit mechanical loads between the first and second connectors 26, 28.

In any of the examples described herein:

The acoustic telemetry assembly 36 may be configured for communication of acoustic signals 22, 24 between the inner mandrel 32 and the first and second connectors 26, 28.

The inner mandrel 32 may be threadedly secured with the second connector 28, and integrally formed with the first connector 26. The inner mandrel 32 may be threadedly secured with the second connector 28, and the inner mandrel 32 may be threadedly secured with the first connector 26. A biasing device 60 may apply a compressive force to the inner mandrel 32.

The above disclosure also provides to the art an acoustic telemetry tool 20 example comprising: first and second string connectors 26, 28 at respective opposite ends of the acoustic telemetry tool 20; a first outer housing 30; first and second inner mandrels 32*a,b* extending longitudinally between the first and second connectors 26,28; a first annular chamber 34 formed radially between the first outer housing 30 and the first inner mandrel 32*a*; and a first acoustic telemetry assembly 36*a* positioned in the first annular chamber 34.

In any of the examples described above:

The first outer housing 30 may be configured to transmit mechanical loads between the first and second connectors 26, 28. The first inner mandrel 32*a* may not be configured to transmit the mechanical loads.

The first acoustic telemetry assembly 36*a* may be rigidly secured to the first inner mandrel 32*a*. A biasing device 60 may apply a compressive force to the first inner mandrel 32*a*.

The acoustic telemetry tool 20 may include an intermediate connector 50. The first inner mandrel 32*a* may extend longitudinally between the first connector 26 and the intermediate connector 50, and the second inner mandrel 32*b* may extend longitudinally between the second connector 28 and the intermediate connector 50.

The acoustic telemetry tool 20 may include a second outer housing 30*b*. The first outer housing 30*a* may extend longitudinally between the first connector 26 and the intermediate connector 50, and the second outer housing 30*b* may extend longitudinally between the second connector 28 and the intermediate connector 50.

The acoustic telemetry tool 20 may include a second annular chamber 34*b* formed radially between the second outer housing 30*b* and the second inner mandrel 32*b*, and a second acoustic telemetry assembly 36*b* positioned in the second annular chamber 34*b*. Each of the acoustic telemetry assemblies 36*a,b* could include at least one battery 38, electronic circuitry 40 and an acoustic telemetry device selected from the group consisting of an acoustic transmitter 44 and an acoustic sensor 42. Alternatively, one of the acoustic telemetry assemblies 36*a,b* could include the battery 38 and electronic circuitry 40, and the other acoustic telemetry assembly could include the acoustic transmitter 44 and/or the acoustic sensor 42.

The first inner mandrel 32*a* may be threadedly secured with the first connector 26, and the first inner mandrel 32*a* may be slidingly and sealingly received in the intermediate connector 50.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An acoustic telemetry tool for use in a subterranean well, the acoustic telemetry tool comprising:

first and second string connectors at respective opposite ends of the acoustic telemetry tool;

a tubular outer housing extending longitudinally between the first and second connectors;

an inner mandrel extending longitudinally between the first and second connectors, an annular chamber being formed radially between the outer housing and the inner mandrel;

a biasing device which applies a compressive force to the inner mandrel; and an acoustic telemetry assembly positioned in the annular chamber, in which the outer housing is configured to transmit mechanical loads between the first and second connectors, but the inner mandrel is configured to not transmit the mechanical loads between the first and second connectors.

2. The acoustic telemetry tool of claim 1, in which the acoustic telemetry assembly is configured for communication of acoustic signals between the acoustic telemetry assembly and the outer housing.

3. The acoustic telemetry tool of claim 1, in which the acoustic telemetry assembly is rigidly secured to the inner mandrel.

4. The acoustic telemetry tool of claim 1, in which the acoustic telemetry assembly is clamped to the inner mandrel.

5. The acoustic telemetry tool of claim 1, in which the acoustic telemetry assembly comprises at least one battery, electronic circuitry and an acoustic telemetry device selected from the group consisting of an acoustic transmitter and an acoustic sensor.

6. The acoustic telemetry tool of claim 1, in which the inner mandrel is threadedly secured with the second connector, and the inner mandrel is longitudinally displaceable relative to the first connector.

7. The acoustic telemetry tool of claim 6, in which the inner mandrel is slidingly and sealingly received in the first connector.

8. An acoustic telemetry tool for use in a subterranean well, the acoustic telemetry tool comprising:

first and second string connectors at respective opposite ends of the acoustic telemetry tool;

a tubular outer housing extending longitudinally between the first and second connectors;

an inner mandrel extending longitudinally between the first and second connectors, an annular chamber being formed radially between the outer housing and the inner mandrel;

a biasing device which applies a compressive force to the inner mandrel; and an acoustic telemetry assembly positioned in the annular chamber, in which the outer housing and the inner mandrel are configured to transmit mechanical loads between the first and second connectors.

9. The acoustic telemetry tool of claim 8, in which the acoustic telemetry assembly is configured for communication of acoustic signals between the inner mandrel and the first and second connectors.

10. The acoustic telemetry tool of claim 8, in which the acoustic telemetry assembly is rigidly secured to the inner mandrel.

11. The acoustic telemetry tool of claim 8, in which the acoustic telemetry assembly is clamped to the inner mandrel.

12. The acoustic telemetry tool of claim 8, in which the acoustic telemetry assembly comprises at least one battery, electronic circuitry and an acoustic telemetry device selected from the group consisting of an acoustic transmitter and an acoustic sensor.

13. The acoustic telemetry tool of claim 8, in which the inner mandrel is threadedly secured with the second connector, and the inner mandrel is integrally formed with the first connector.

14. The acoustic telemetry tool of claim 8, in which the inner mandrel is threadedly secured with the second connector, and the inner mandrel is threadedly secured with the first connector.

15. An acoustic telemetry tool for use in a subterranean well, the acoustic telemetry tool comprising:

first and second string connectors at respective opposite ends of the acoustic telemetry tool;

a first outer housing;

first and second inner mandrels extending longitudinally between the first and second connectors;

a biasing device which applies a compressive force to the first inner mandrel;

a first annular chamber formed radially between the first outer housing and the first inner mandrel; and a first acoustic telemetry assembly positioned in the first annular chamber.

16. The acoustic telemetry tool of claim 15, in which the first outer housing is configured to transmit mechanical loads between the first and second connectors.

17. The acoustic telemetry tool of claim 16, in which the first inner mandrel is not configured to transmit the mechanical loads.

18. The acoustic telemetry tool of claim 15, in which the first acoustic telemetry assembly is rigidly secured to the first inner mandrel.

19. The acoustic telemetry tool of claim 15, further comprising an intermediate connector, and in which the first inner mandrel extends longitudinally between the first connector and the intermediate connector, and the second inner mandrel extends longitudinally between the second connector and the intermediate connector.

20. The acoustic telemetry tool of claim 19, further comprising a second outer housing, and in which the first outer housing extends longitudinally between the first connector and the intermediate connector, and the second outer housing extends longitudinally between the second connector and the intermediate connector.

21. The acoustic telemetry tool of claim 20, in which a second annular chamber is formed radially between the second outer housing and the second inner mandrel; and further comprising a second acoustic telemetry assembly positioned in the second annular chamber.

22. The acoustic telemetry tool of claim 19, in which the first inner mandrel is threadedly secured with the first connector, and the first inner mandrel is slidingly and sealingly received in the intermediate connector.

23. The acoustic telemetry tool of claim 15, in which the first annular chamber is also formed radially between the first outer housing and the second inner mandrel; and further comprising a second acoustic telemetry assembly positioned in the first annular chamber.

* * * * *